US006802126B2

(12) United States Patent
Huang

(10) Patent No.: US 6,802,126 B2
(45) Date of Patent: Oct. 12, 2004

(54) UTILITY KNIFE

(76) Inventor: Harrison Huang, No. 23, Lin T'So Rd., Sheng Kang Hsian, Taichung Hsien, Taichung Hsien (TW), 429

( * ) Notice: Subject to any disclaimer, the term of this patent is extended or adjusted under 35 U.S.C. 154(b) by 0 days.

(21) Appl. No.: 10/373,832

(22) Filed: Feb. 27, 2003

(65) Prior Publication Data

US 2004/0158992 A1 Aug. 19, 2004

(51) Int. Cl.[7] ..... B26B 1/08
(52) U.S. Cl. ..... 30/162; 30/336
(58) Field of Search ..... 30/162, 335, 336, 30/125

(56) References Cited

U.S. PATENT DOCUMENTS 5,022,156 A * 6/1991 Kallens et al. ..... 30/125
6,223,439 B1 * 5/2001 Wonderley ..... 30/162
2002/0124411 A1 * 9/2002 Huang ..... 30/161

* cited by examiner

*Primary Examiner*—Douglas D Watts
(74) *Attorney, Agent, or Firm*—Bacon & Thomas, PLLC

(57) ABSTRACT

A utility knife includes a handle having a first casing and a second casing, a blade holder slidably received in the handle, a blade mounted on the blade holder, means for driving the blade holder moving, and a lock device pivoted on the first casing of the handle to be turned between an unlock position and a lock position. The lock device is fastened on the first casing having a base member positioned at an exterior side of the first casing and a rotatable member positioned at an interior side thereof The rotatable member has two ribs projected radially to pass through a through hole with two gaps on first casing. Such that the first casing and second casing can be assembled and disassembled by turning the lock device.

15 Claims, 6 Drawing Sheets

UTILITY KNIFE

BACKGROUND OF THE INVENTION

1. Field of the Invention

The present invention relates generally to a cutting tool, and more particularly to a utility knife.

2. Description of the Related Art

A conventional utility knife has a handle and a blade retractably disposed in the handle. The handle consisted of two casings detachably combined together so that the casings are disassembled while the knife needed to be replaced.

In the prior art, U.S. Pat. No. 5,303,469 and U.S. Pat. No. 5,875,551 disclosed a cap to secure two casings. The first patent taught the cap engaged with the casings at rear ends thereof, under such condition, the cap will be totally disassembled from the casings and that might cause the cap easy to be lost. The second patent taught a shaft slidably mounted on one of the casings and connecting a rear end thereof with the cap such that the cap can be drawn out and be turned an angle to make the casings can be disassembled. In this patent provided the cap not disassembled from the casing, but it provided a complex structure.

SUMMARY OF THE INVENTION

The primary objective of the present invention is to provide a utility knife, which has a simpler mechanism to assemble and disassemble two casings in an easier way.

According to the objective of the present invention, a utility knife comprises a handle having a first casing and a second casing, a blade holder slidably received in the handle, a blade mounted on the blade holder, means for driving the blade holder moving, and a lock device pivoted on the first casing of the handle to be turned between an unlock position and a lock position. The lock device has at least a rib projected from a diameter orientation thereof. The second casing has a through hole and a gap beside the through hole and communicated with the through hole whereby the second casing is secured with the first casing while the lock device runs through the through hole of the second casing and is turned to the lock position for the rib against the second casing and the second casing is disassembled from the first casing while the lock device is turned to the unlock position for the rib corresponding to the gap.

DETAILED DESCRIPTION OF THE INVENTION

Figure 1:
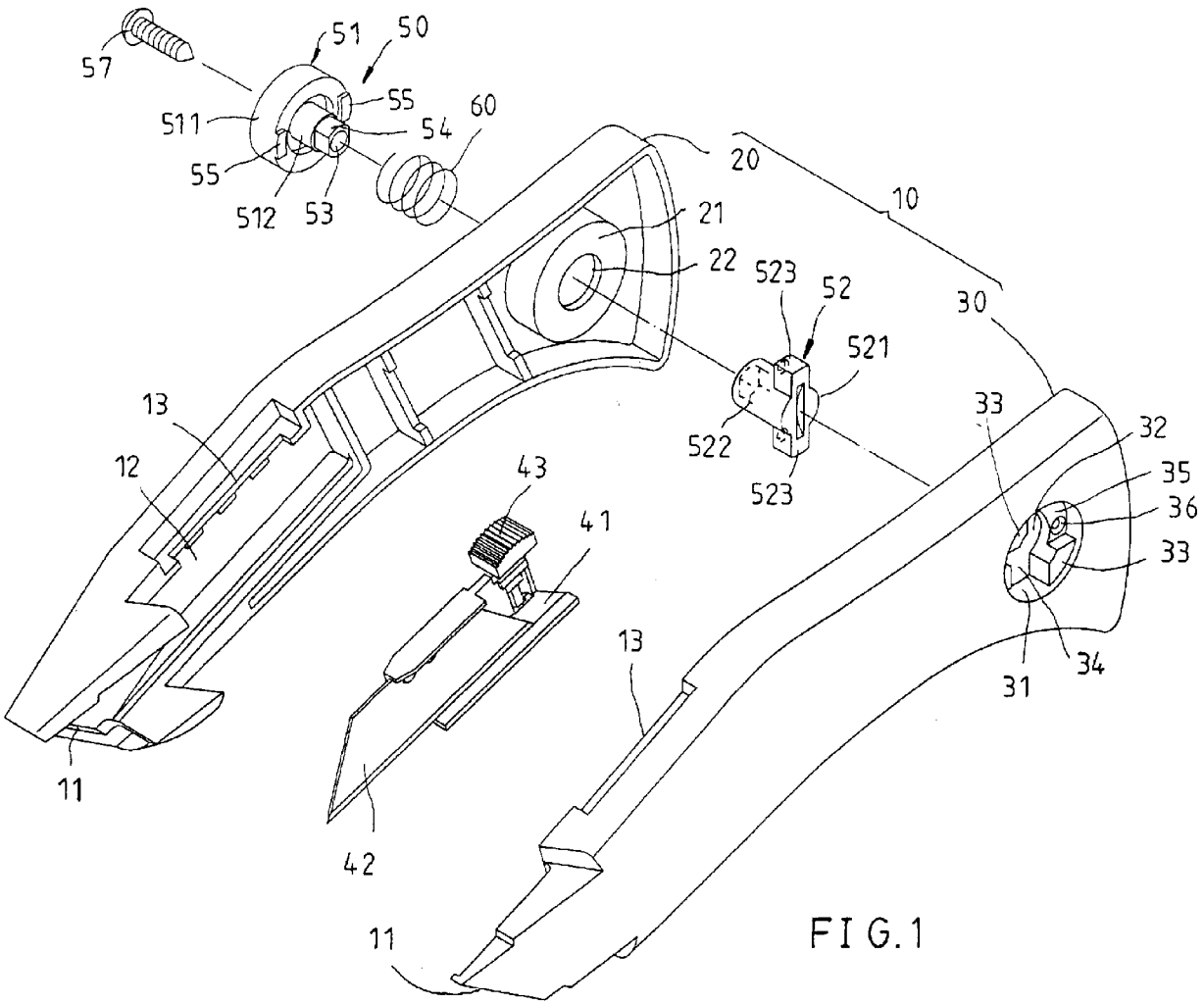
FIG. 1 is an exploded view of a first preferred embodiment of the present invention.

Please refer to FIG. 1, a utility knife of the first preferred embodiment of the present invention mainly comprises a handle 10, a blade holder 41, a blade 42, a driving device 43 and a lock device 50, wherein The handle 10 consists of a first casing 20 and a second casing 30 detachably assembled together. The handle 10 has an opening 11 at a front end thereof, a guiding track 12 therein behind the opening 11 and a slot 13 at a top thereof communicated with the guiding track 12.

The blade holder 41 is received in the handle 10 and is engaged with the guiding track 12 and the blade 42 is mounted on the knife holder 41. The driving device 43 is connected an interior end thereof with the blade holder 41 and is extruded an exterior end thereof out of the handle 10 via the slot 13 such that the driving device 43 is moved to push the blade 42 out or draw it into the handle 10 via the opening 11.

Figure 4:
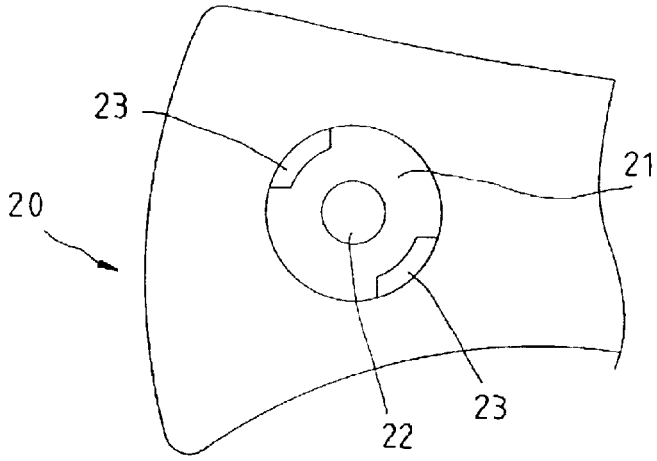
FIG. 4 is a front view in part of the first casing of the first preferred embodiment of the present invention.
Figure 5:
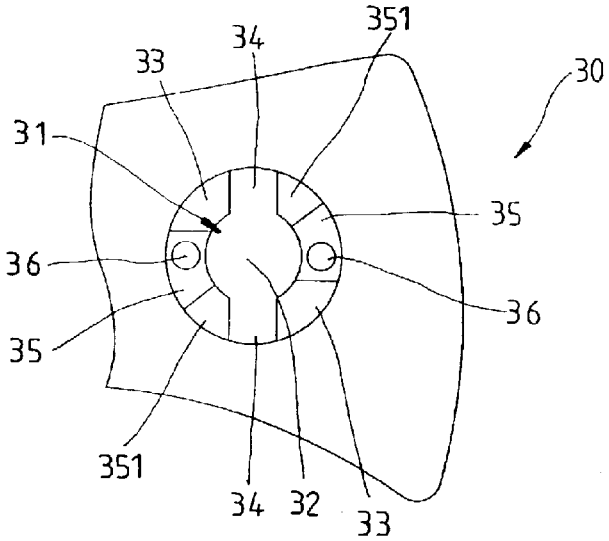
FIG. 5 is a rear view in part of the second casing of the first preferred embodiment of the present invention.

The above elements are as same as the prior art, the improvements of the present invention are hereunder:

As shown in FIG. 4, the first casing 20 has a round recess portion 21 at a rear side thereof where has a through hole 22 at a center of a bottom side and two blocks 23 beside the through hole 22.

The second casing 30 has a recess portion 31, a through hole 32, two blocks 33 and two gaps 34 at opposite side of the through hole 32 and communicated with the through hole 32. Each gap 34 is next to the block 33 respectively so that a sliding face 35 is defined at a bottom side of the recess portion 31 between the block 33 and the other one gap 34 and the sliding face 35 has a recess 36 adjacent to the block 33 and a sloped face 351 adjacent to the gap 34.

Figure 6:
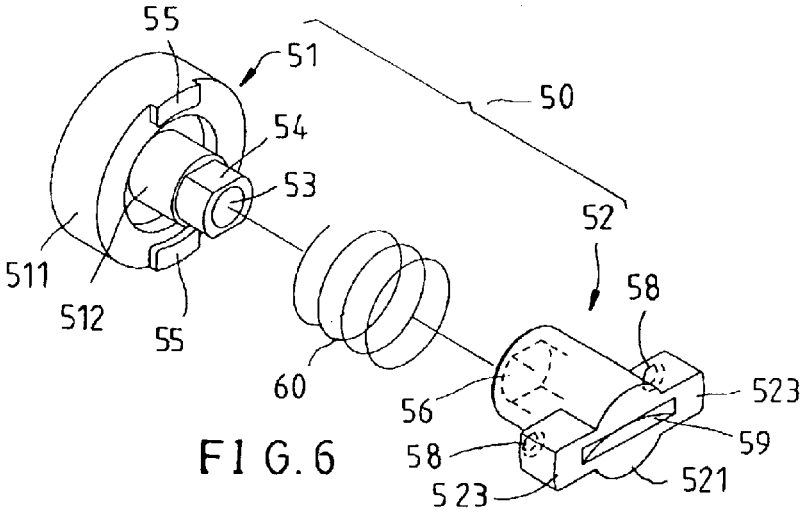
FIG. 6 is an exploded view of the lock device of the first preferred embodiment of the present invention.

The lock device 50, as shown in FIG. 6, has a base member 51 and a rotatable member 52. The base member 51 has a round base portion 511 and a rod portion 512 projected from a center of an interior side of the base portion 511, wherein the base portion 511 is received in the recess portion 21 of the first casing 20 and the rod portion 512 runs through the through hole 22. The base member 51 has a hole 53 running through the base portion 511 and the rod portion 512. The rod portion 512 has an engaging portion 54 at a distal end thereof having a cross-section other than round. The base portion 511 has two blocks 55 at the interior side beside the rod portion 512 such that the base member 51 only can rotate between the blocks 23 of the first casing 20.

The rotatable member 52 has a head portion 521, a rod portion 522 and two ribs 523. The head portion 521 is a round block where the rod portion 522 is projected from a center of an interior side thereof and the ribs 523 are projected radially along opposite orientations respectively which has a protrusion 58 at a bottom side thereof The rod portion 522 has a hole 56 corresponding to the engaging portion 54 at a distal end thereof The rotatable member 52 is secured to the base member 51 by means of the engaging portion 54 inserted into the hole 56 and a screw or bolt 57 running through the hole 53 of the base member 51 and screwed into the rod portion 522 of the rotatable member 52.

An elastic member 60, which is a spiral spring in the present preferred embodiment, is engaged to the rod portion 512 of the base member 51 with opposite ends thereof against the base portion 512 of the base member 51 and the bottom side of the recess portion 21 of the first casing 20.

Figure 2:
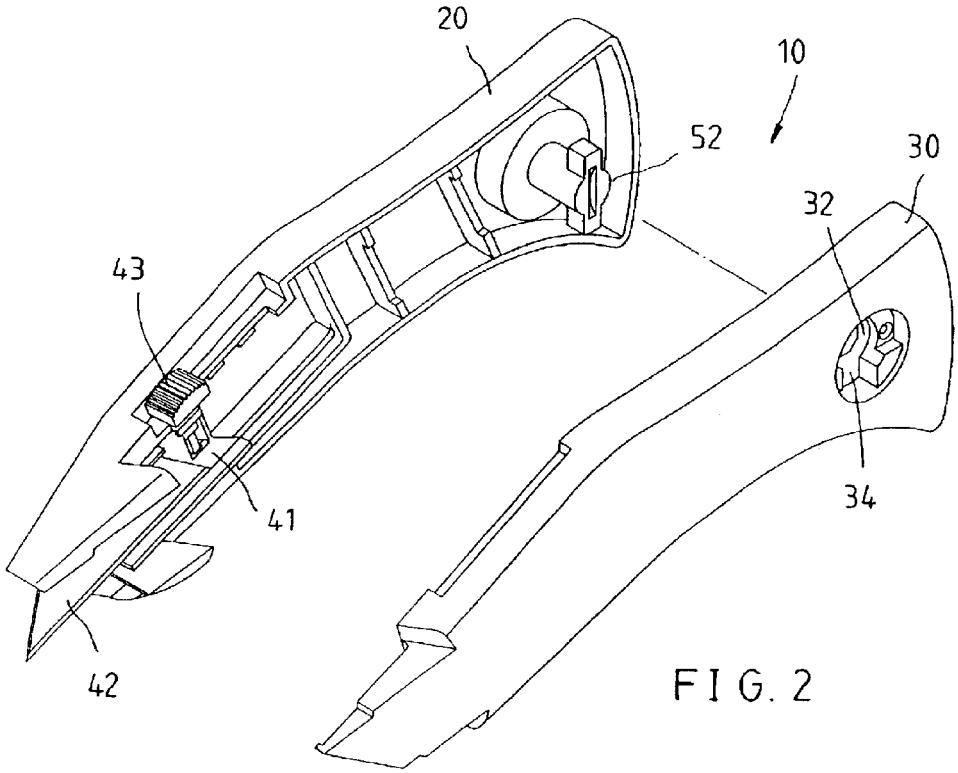
FIG. 2 is a perspective view the first preferred embodiment of the present invention, showing the casings disassembled.
Figure 3:
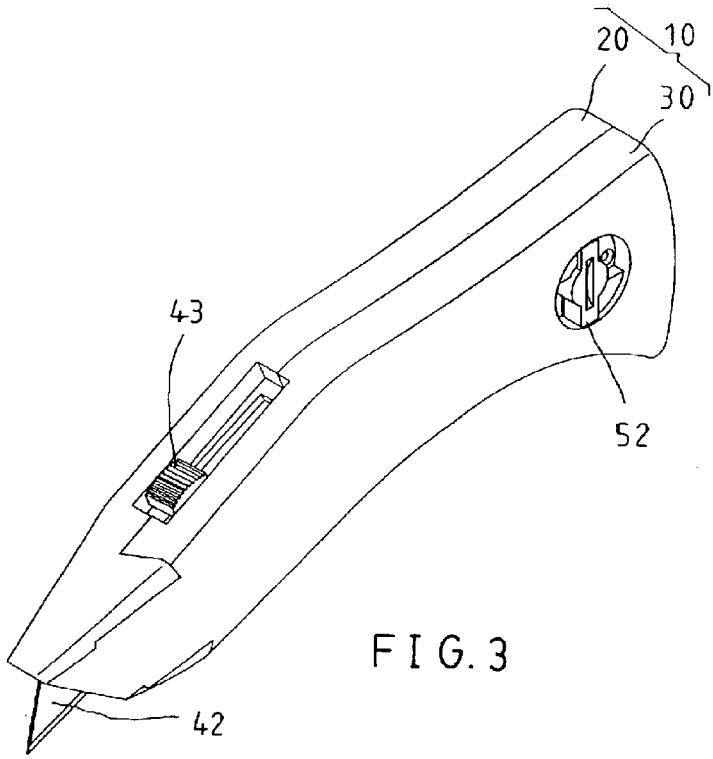
FIG. 3 is a perspective view the first preferred embodiment of the present invention, showing the casings assembled.

The lock device 50 is secured on the second casing 20 with the base member 51 located at an interior side of the second casing 20 and the rotatable member 52 located at an exterior side as shown in FIG. 2 and the lock device 50 can be turned between a fist position and a lock position.

Figure 7:
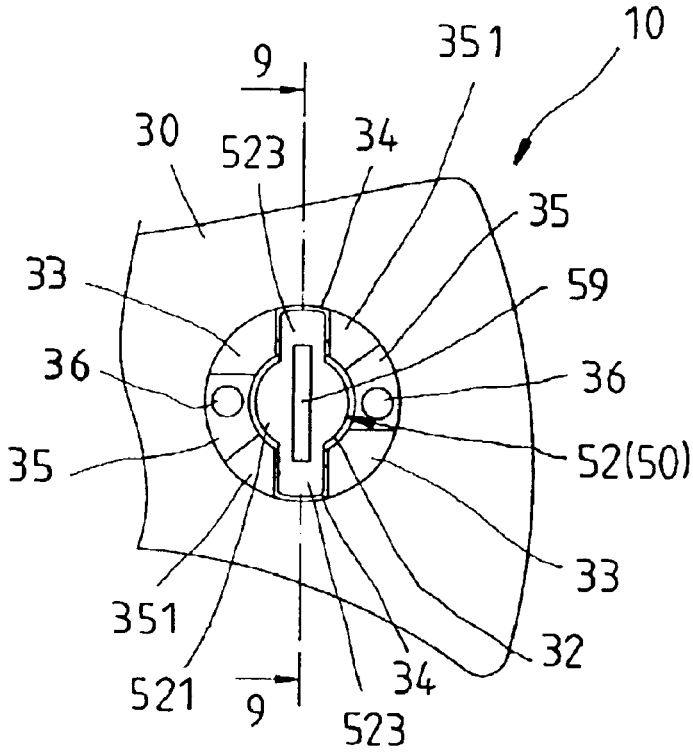
FIG. 7 is a front view in part of the first preferred embodiment of the present invention, showing the lock device being turned to a lock position.
Figure 8:
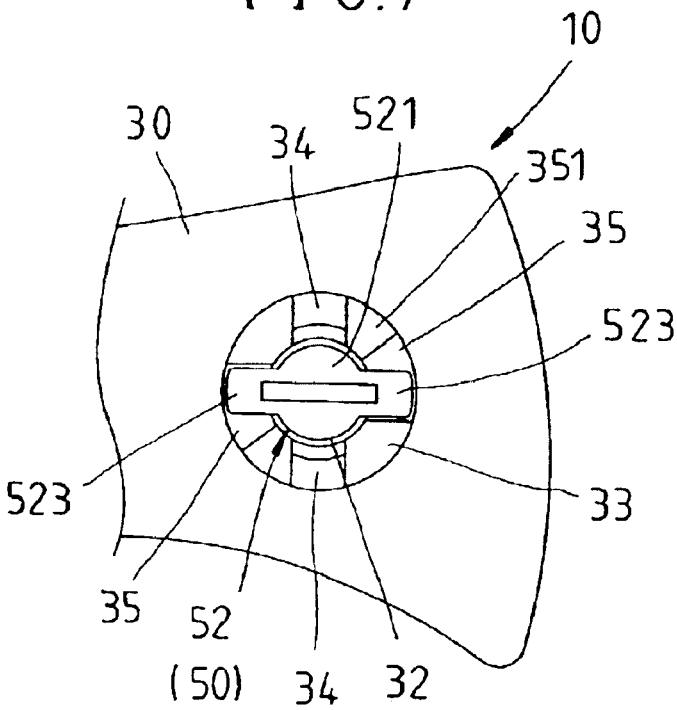
FIG. 8 is a front view in part of the first preferred embodiment of the present invention, showing the lock device being turned to an unlock position.

The shape of the cross-section of the head portion 521 and the ribs 523 of the rotatable member 52 corresponds to the shape of the hole 32 and the gaps 34 such that the rotatable member 52 runs through the second casing 30 via the hole 32 and the gaps 34 while the rotatable member 52 is turned to the unlock position and the first and second casings 20 and 30 are assembled as shown in FIG. 7. The rotatable member 52 can be turned to the lock position in which the ribs 523 will slide on the sliding faces 35 via the sloped faces 351 respectively and finally the protrusions 58 fall into the recesses 36 respectively as shown in FIG. 8. In other words, the first and second casings 20 and 30 can be assembled and disassembled when the rotatable member 52 is turned to the unlock position (FIG. 7) and the first and second casings 20 and 30 are secured together when the rotatable member 52 is turned to the lock position (FIG. 8).

Figure 9:
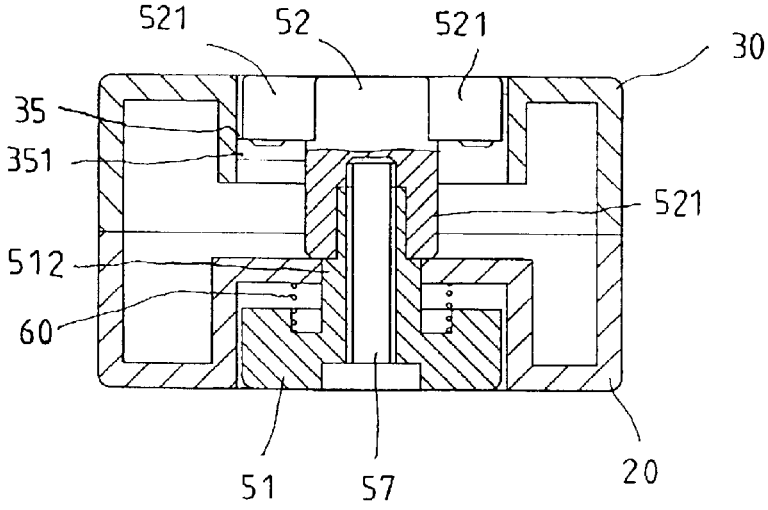
FIG. 9 is a sectional view along the 9—9 line in FIG. 7.

There is a clearance between the lock device 50 and the first casing 20 and the elastic member 60 keeps the lock device 50 at lowest position at where the distal end of the rod portion 522 is against the first casing 20 as shown in FIG. 9 that will make less friction between the ribs 523 and the sliding faces when the rotatable member 52 is moved between the unlock position and the lock position and keep the protrusions 58 rested in the recesses 36 when the rotatable member 52 is moved to the lock position.

The lock device 50 further has a elongated recess 59 at a exterior side of the head portion 521 of the rotatable member 52 to engage a coin therein for user can turn the lock device 50 easily.

Figure 10:
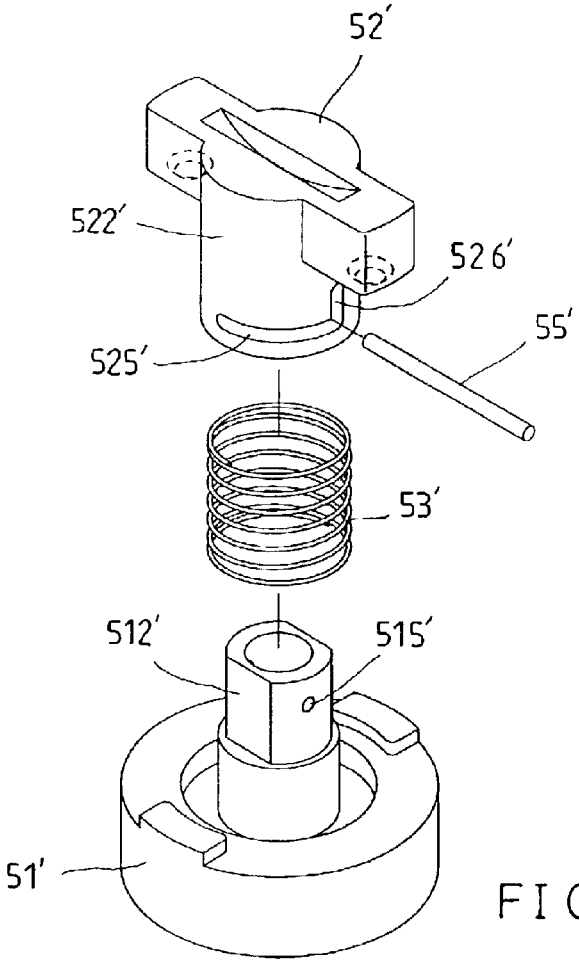
FIG. 10 is an exploded view of the lock device of a second preferred embodiment of the present invention.
Figure 11:
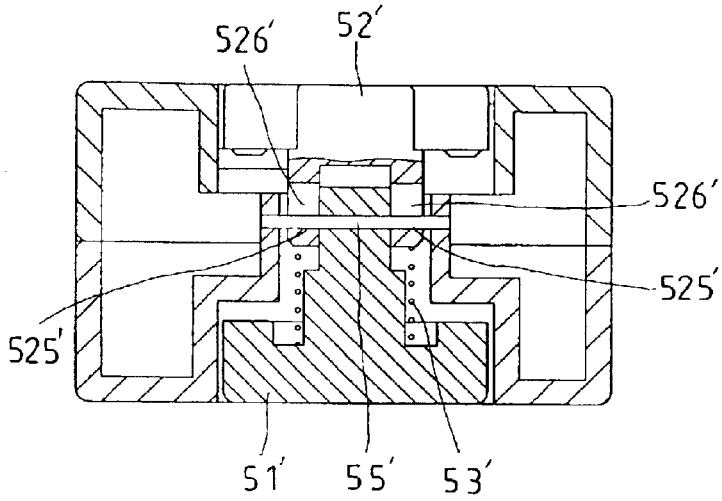
FIG. 11 is a sectional view of the second preferred embodiment of the present invention.
Figure 12:
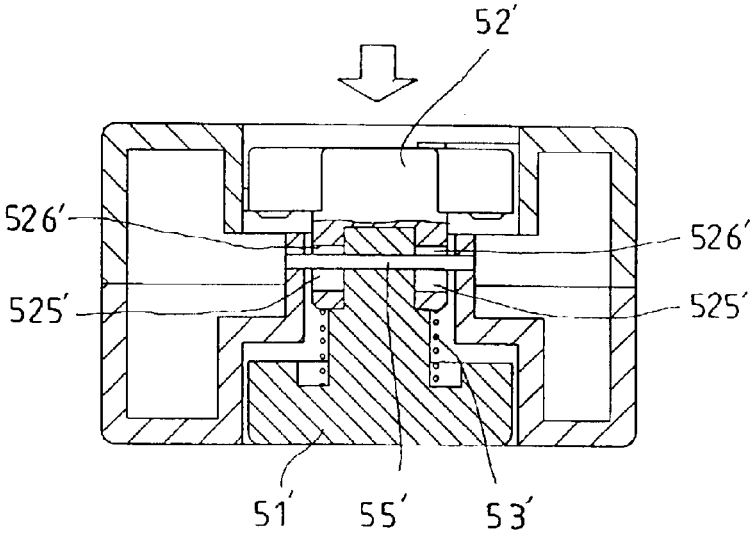
FIG. 12 is a sectional view of the second preferred embodiment of the present invention showing the lock device being pressed downwardly.

FIG. 10 shows a utility knife of a second preferred embodiment of the present invention, which is similar to the first preferred embodiment, comprising a lock device 50' having a base member 51', a rotatable member 52' and a spring 53'. The base member 51' has a rod portion 512' connected with a rod portion 522' of the rotatable member 52'. The rod portion 522' of the rotatable member 52' has two L-shaped slots each of which has a transverse slot 525' and an axial slot 526' located at the opposite side of the rod portion 522'. The rod portion 512' of the base member 52' has a through hole 515' along a diameter orientation thereof. The rotatable member 52' is connected to the base member 51' by means of a pin 55' inserted into the L-shaped slots 525' and 526' and the through hole 515' and the base member 51' is secured on the first casing 20 by the pin 55' inserted into holes on the first casing 20. The spring 53' has opposite ends against the base member 51' and the rotatable member 52'. The rotatable member 52' can be turned relative to the base member 51' while the pin 55' slides along the transverse slots 525' and also can be moved toward the base member 51' while the pin 55' slides along the axial slots 526'. As same as above, the rotatable member 52' can be turned between an unlock position and a lock position to lock or release the second casing 30. The pin 55' can enter the axial slots 526' only when the rotatable member 52' is turned to the lock position such that the rotatable member 52' can be pressed downwardly (as shown in FIG. 11) to make the first and second casings 20 and 30 disassembled easier.

What is claimed is:

1. A utility knife, comprising:

a handle having a first casing and a second casing, a blade holder slidably received in said handle, a blade mounted on said blade holder, means for driving said blade holder to move, and a lock device pivoted on said first casing of said handle to be turned between an unlock position and a lock position, wherein said lock device has at least a rib projected from a diameter orientation thereof and said second casing has a through hole and a gap beside said through hole and communicates with said through hole;

whereby said second casing is secured with said first casing while said lock device runs through said through hole of said second casing and is turned to the lock position for said rib against said second casing and said second casing is disassembled from said first casing while said lock device is turned to the unlock position for said rib corresponding to said gap;

said first casing has a recess portion having a through hole at a bottom side thereof and said lock device has a base member having a base portion received in said recess portion and a rod portion through said through hole; and wherein said first casing has at least a block at the bottom side of said recess portion and said lock device has at least a block at an interior side of said base portion to limit said lock device only rotating within a predetermined angle.

2. A utility knife, comprising:

a handle having a first casing and a second casing, a blade holder slidably received in said handle, a blade mounted on said blade holder, means for driving said blade holder to move, and a lock device pivoted on said first casing of said handle to be turned between an unlock position and a lock position, wherein said lock device has at least a rib projected from a diameter orientation thereof and said second casing has a through hole and a cap beside said through hole and communicates with said through hole;

whereby said second casing is secured with said first casing while said lock device runs through said through hole of said second casing and is turned to the lock position for said rib against said second casing and said second casing is disassembled from said first casing while said lock device is turned to the unlock position for said rib corresponding to said gap; and wherein said second casing has a sliding face beside said gap on which has a recess and said rib has a protrusion to be received in said recess while said lock device is turned to the lock position.

3. The utility knife as defined in claim 2, wherein said second casing has a recess portion with said through hole and said rib at a bottom side thereof.

4. The utility knife as defined in claim 2, wherein said first casing has a block adjacent to said gap against which said rib of said lock device is turned to the lock position.

5. The utility knife as defined in claim 2, wherein said lock device has an elongated recess to be engaged with a coin.

6. The utility knife as defined in claim 2, wherein said lock device has a base member and a rotatable member, wherein said base member is fastened with said rotatable member and said base member is positioned at a side of said first casing and said rotatable member is positioned at the opposite side of said first casing and said rotatable member has said rib thereon.

7. The utility knife as defined in claim 2, wherein said lock device further comprises a spring with opposite ends thereof against said base member and said first casing respectively.

8. A utility knife, comprising:

a handle having a first casing and a second casing, a blade holder slidably received in said handle, a blade mounted on said blade holder, means for driving said blade holder to move, and a lock device pivoted on said first casing of said handle to be turned between an unlock position and a lock position, wherein said lock device has at least a rib projected from a diameter orientation thereof and said second casing has a through hole and a gap beside said through hole and communicates with said through hole;

whereby said second casing is secured with said first casing while said lock device runs through said through hole of said second casing and is turned to the lock position for said rib against said second casing and said second casing is disassembled from said first casing while said lock device is turned to the unlock position for said rib corresponding to said gap; and wherein said second casing has a sliding face beside said gap on which has a sloped face adjacent to said gap.

9. The utility knife as defined in claim 8, wherein said rotatable member has a transverse slot and a pin inserted into said transverse slot and said base member.

10. The utility knife as defined in claim 9, wherein said rotatable member further has an axial slot having an end thereof communicated with an end of said transverse slot.

11. The utility knife as defined in claim 10, wherein said lock device further has a spring against which opposite ends on said base member and said rotatable member respectively.

12. The utility knife as defined in claim 1, wherein said second casing has a recess portion with said through hole and said rib at a bottom side thereof.

13. The utility knife as defined in claim 1, wherein said first casing has a block adjacent to said gap against which said rib of said lock device is turned to the lock position.

14. The utility knife as defined in claim 1 wherein said lock device has an elongated recess to be engaged with a coin.

15. The utility knife as defined in claim 1, wherein said lock device has a base number and a rotatable member, wherein said base member is fastened with said rotatable member and said base member is positioned at a side of said first casing and said rotatable member is positioned at the opposite side of said first casing and said rotatable member has said rib thereon.

* * * * *